US005312092A

United States Patent [19]

Decker et al.

[11] Patent Number: 5,312,092

[45] Date of Patent: May 17, 1994

[54] GAS PURGING PLUG

[75] Inventors: Jens Decker, Bad Honnef, Fed. Rep. of Germany; Andreas Batton, Radenthein, Austria

[73] Assignee: Radex-Heraklith Industriebeteiligungs Aktiengesellschaft, Vienna, Austria

[21] Appl. No.: 904,715

[22] Filed: Jun. 26, 1992

[30] Foreign Application Priority Data

Jun. 28, 1991 [DE] Fed. Rep. of Germany ..... 4121329

[51] Int. Cl.[5] ..... C21C 5/48

[52] U.S. Cl. ..... 266/220; 266/265

[58] Field of Search ..... 266/218, 220, 265

[56] References Cited

U.S. PATENT DOCUMENTS 4,840,356 6/1989 Labate ..... 266/224

FOREIGN PATENT DOCUMENTS

3904543A1 11/1989 Fed. Rep. of Germany .
3833505C1 2/1990 Fed. Rep. of Germany .
3833502A1 4/1990 Fed. Rep. of Germany .

*Primary Examiner*—Melvyn J. Andrews
*Attorney, Agent, or Firm*—John F. A. Earley; John F. A. Earley, III

[57] ABSTRACT

The present invention pertains to a gas purging plug for metallurgical vessels with a gas connection pipe at the gas inlet-side, lower end.

11 Claims, 2 Drawing Sheets

GAS PURGING PLUG

Figure 1:
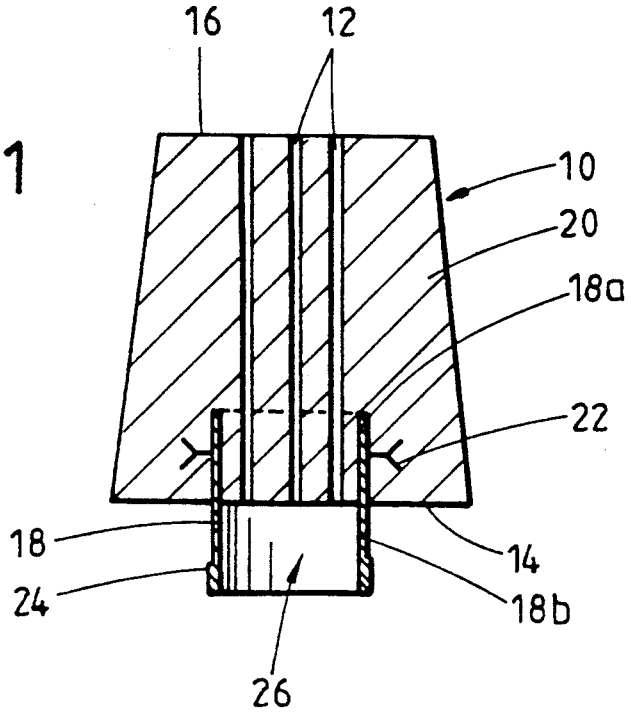

The present invention pertains to a gas purging plug for metallurgical vessels with a gas connection pipe at the gas inlet-side lower end.

Various designs of gas purging plugs are reviewed on pages 288 to 302 of the 1987 *Radex-Rundschau.*

The gas purging plugs are usually jacketed with sheet metal, and the bottom of the sheet metal jacket extends at a distance from the bottom of the ceramic part of the gas purging plug, so that a gas distribution chamber is formed, and a gas connection pipe joins the bottom of the sheet metal jacket (DE 36,23,609 C1).

As can be determined from DE 38,33,502 A1, such as purging plug includes various metal parts, and is therefore expensive. For simplification, it is suggested in DE 38,33,502 A1 that the gas distribution chamber be designed such that it is open toward the gas inlet-side end and is designed as a sealing surface there, which extends around the corresponding opening and to which a closing part provided with a gas connection can be detachably attached. Even though the closing part can thus be reused, a large number of metal parts are needed, as before. The arrangement of a so-called breakthrough-preventing means, which is described in DE 38,30,871 C1, is also possible only conditionally in the prior-art gas purging plug. Finally, breaking out of the gas purging plug after use is made difficult.

Therefore, the basic task of the present invention is to simplify the design of a gas purging plug of the class described above and to design it such that any assembly units, such as a gas distribution chamber or a breakthrough-preventing means, can be connected without any problem, and the purging plug can be easily removed after it has become worn out.

To achieve this, a gas purging plug of the class described in the introduction is proposed, which possesses the following characteristics:

The gas connection pipe extends from the bottom of the gas purging plug in the direction of its end face, and is fixedly secured in the ceramic matrix material of the gas purging plug, at its gas inlet-side end, the gas connection pipe has a device for gas-tight connection to a gas distribution chamber and/or [to] a gas feed line, and with its gas outlet-side end section, the gas outlet pipe connection joins a gas-permeable section of the gas purging plug.

In other words: The gas connection pipe is placed at least partially into the interior of the ceramic part of the gas purging plug and is anchored there. At the same time, it is designed such that further components can be connected to this gas connection pipe. This may be a gas connection tube, which itself is, e.g., part of a breakthrough-preventing means as described in DE 38,30,871 C1.

If the portion of the gas connection pipe extending into the ceramic material is made "hollow," a type of gas distribution chamber can be provided at the same time inside the gas connection pipe in the area of the ceramic part of the gas purging plug. However, even if the gas connection pipe, which is, e.g., cylindrical, is located completely within the (gas-permeable) ceramic matrix material, a gas distribution chamber can be provided quasi "in situ" by the gas connection pipe projecting in the downward direction over the bottom of the ceramic part of the gas purging plug, and the gas distribution chamber being provided between the free end of the gas connection pipe and the bottom of the ceramic part of the gas purging plug.

While the gas-permeable portion of the gas purging plug (especially if it is provided with gas canals) joins the upper end section of the gas connection pipe extending in the matrix material in the first case, the gas-permeable part (e.g., the gas canals) extend directly from the bottom of the gas purging plug to its end face in the second case.

However, a larger gas distribution chamber may also be arranged at the gas outlet-side end of the gas connection pipe. It may either be hollow (which is achieved, e.g., by burning out a corresponding filling body, which filled the corresponding volume during preparation), or be covered with a perforated cover. It is also possible to arrange a gas-permeable, preferably ceramic, refractory plug in the gas distribution chamber. This [plug] may act at the same time as a "breakthrough-preventing means" against possibly infiltrating metal melt by subdividing the metal melt flow, which will "freeze" more rapidly as a result. However, the insert may also be used to determine the thickness of the remaining brick if it has, e.g., a thermal conductivity different from that of the matrix material, so that erosion reaching this point can be recognized from a different "heat color."

It is obvious that the following advantages are achieved simultaneously with these embodiments:

A sheet metal jacketing can be eliminated, because the gas connection pipe is anchored directly in the ceramic material.

Since a sheet metal jacket is absent, the purging plug can be fabricated directly with a corresponding nozzle brick (well nozzle), e.g., by casting the purging plug directly into a nozzle brick. Thus, only one body needs be built into the metallurgical vessel.

The device for the gas-tight connection of further components, which is arranged at the gas inlet-side (lower) end of the gas connection pipe, can be used—after removing these components—as an adapter for connecting an extraction device, via which the gas purging plug can be pulled out of the bottom-side anchoring in the metallurgical melting vessel after wear.

Figure 2:
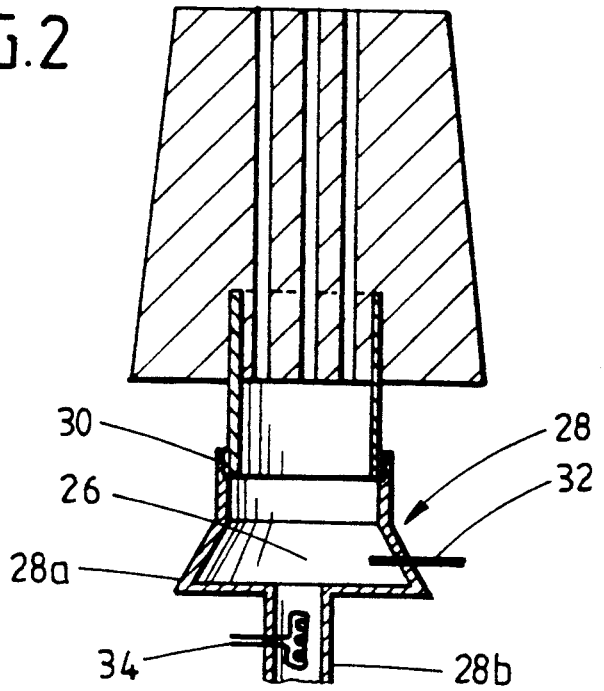

A gas purging plug, in which a gas distribution chamber, to which a gas connection pipe is connected, is provided beneath the ceramic body, has been known from EP 0,070,197 A1 (FIG. 2). Even though this assembly unit, consisting of a gas distribution chamber and a gas connection pipe, can be considered to be a gas connection pipe, it runs below the ceramic body of the purging plug. It follows from this that there is no firm mechanical anchoring between the gas connection pipe and the ceramic body. As a result, it is impossible with the prior-art design to pull the purging plug, after it has become worn, from, e.g., a nozzle brick via the gas connection pipe.

The design according to the present invention offers numerous further advantages.

Thus, one (additional) detachable blast box (gas distribution chamber), to which itself a gas feed line can be connected, can be connected to the device at the gas inlet-side end of the gas connection pipe. The blast box can be connected without problems at the plant. This blast box may be equipped with, e.g., thermocouples for measuring the gas temperature, or with a device for heating the gas. Due to the gas distribution chamber being detachable in this design, it [the gas distribution chamber] can be removed prior to the removal of a worn purging plug and be reused. This is of great economic advantage especially in view of the expensive auxiliary devices. In addition, the dimensioning of the blast box and of the connection-side connection elements can be determined by the user himself, e.g., the steel mill.

This also applies to the association of a breakthrough-preventing means or to the possibility of connecting different gas lines, e.g., for different gases. Finally, this separate assembly unit, which is detachable from the gas purging plug, can also be used to accommodate a pressure gauge in order to measure the gas pressure.

The mechanical anchoring of the gas connection pipe in the ceramic matrix material can be accomplished in different ways.

According to a first embodiment, it is proposed that at least the gas outlet-side section of the gas connection pipe be inserted at the time of casting of the gas purging plug. It is advantageous here for the corresponding section of the connection pipe to have reinforcing elements on the outside, which improve the mechanical anchoring between the connection pipe and the ceramic of the purging plug. The anchoring of the connection pipe can also be facilitated by providing it, on the upper end section, with holes through which matrix material penetrates during casting.

In a pressed gas purging plug, an annular, bottom-side groove is advantageously provided on the finished product, and the corresponding cylindrical section of the gas connection pipe is subsequently mortared in this groove. Reinforcing elements for improving anchoring are advantageous in this case as well.

Especially if the blast box is to be directly formed along with the remainder, the gas connection pipe is tapered in the lower section in one embodiment, and the connection means is provided at the free end of this tapered section.

The device for gas-tight connection to the blast box (the gas distribution chamber) and/or a gas feed line can consist in this case of, e.g., a threaded section or a bayonet fastener. However, it is also possible to provide the end side of the gas connection pipe with a flange, which ensures a usual flanged connection together with a flange of the adjacent component.

It is common to all embodiments that a universal connection possibility for gas feed lines, gas distribution chambers (with or without auxiliary devices) and/or extraction devices is provided by means of a simple, especially metallic gas connection pipe, which is anchored at least partially in the ceramic matrix material of the purging plug. The gas connection pipe not only has a simple design, but can also be positioned with ease. Conversions of the gas purging plug are not necessary. A sheet metal jacketing may be omitted.

The gas purging plug may be provided with oriented or non-oriented porosity. In the case of non-oriented porosity, it [the gas purging plug] is advantageously designed as a two-part purging plug, in which the porous section is arranged on the inside and is surrounded by an impermeable ceramic material.

Further advantages of the present invention will become apparent from the characteristics of the subclaims as well as the other application documents.

Figure 3:
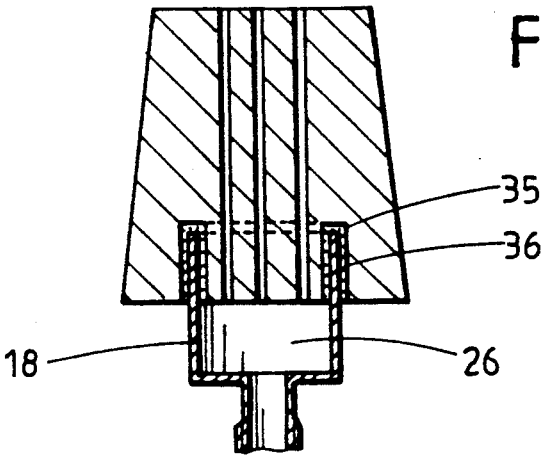
Figure 4:
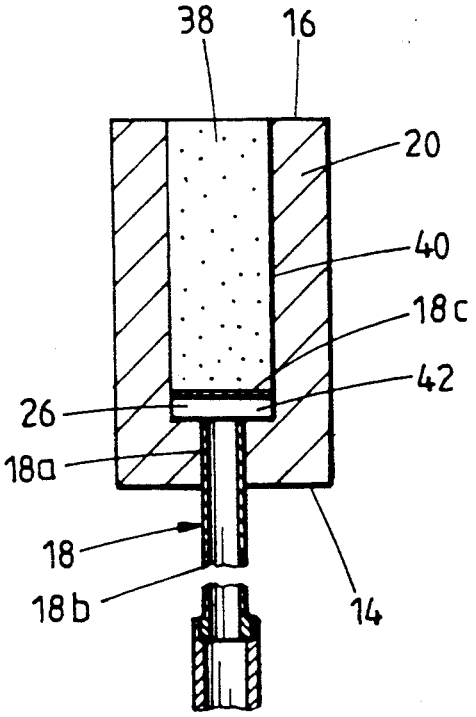
Figure 5:
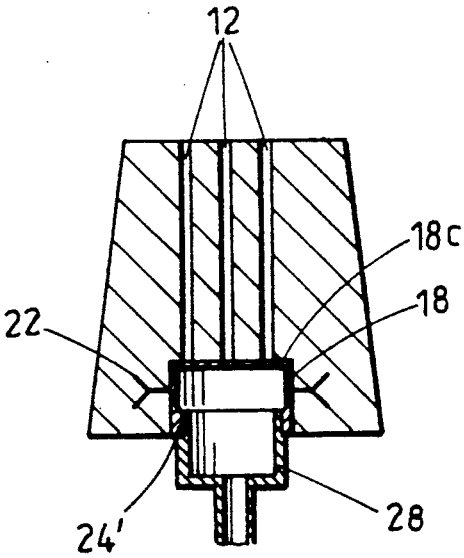

The present invention will be described below as an example on the basis of various exemplified embodiments. In highly schematic representations, FIG. 1 shows a longitudinal section through a first embodiment of a gas purging plug, FIG. 2 shows the gas purging plug according to FIG. 1 with a connected blast box, FIG. 3 shows the longitudinal section of a second embodiment of the gas purging plug, FIG. 4 shows the longitudinal section of a third embodiment of the gas purging plug, and FIG. 5 shows, likewise in longitudinal section, another embodiment of the gas purging plug.

Identical or functionally identical components are represented with the same reference numerals in the figures.

The ceramic body of the gas purging plug according to FIG. 1 is designated by reference numeral 10.

It is a gas purging plug with so-called oriented porosity. The gas canals 12 extend, at spaced locations from one another, vertically from the bottom 14 to the end face 16 of the said ceramic body 10, and, as is shown here, only approximately in the middle.

A cylindrical gas connection pipe 18 extends around the said gas canals 12 and into the refractory ceramic matrix material 20 of the said body 10, and is sealed in there. For better anchoring in the said matrix material 20, the upper section **18*a* of the said connection pipe 18 has reinforcing anchors 22** on the outside.

The said connection pipe 18 projects over the said bottom 14 for a certain distance. The said projecting lower section **18*b* of the said connection pipe 18 is provided with external threads 24**.

Sheet metal jacketing of the said ceramic body 10 for providing a gas connection pipe and/or a gas distribution chamber is consequently unnecessary in this embodiment.

The chamber 26 within the said lower section **18*b* of the said connection pipe 18 can instead be used as a gas distribution chamber, and a gas feed pipe can be connected via the said external threaded section 24**.

In this embodiment, the said connection pipe 18 may also have, at its lower free end, a tapered connection piece, as is shown in FIG. 3 and as will be explained later.

However, the embodiment according to FIG. 1 also makes it possible, above all, to connect an—independent—gas distribution chamber, if desired, with further auxiliary devices, as is shown in the exemplified embodiment according to FIG. 2.

An essentially cylindrical metallic body 28, which has internal threads 30 at its upper end, is connected gas-tight to the external threads 24 of the said connection pipe 18.

Starting from the said external threads 30, the said body 28 first extends cylindrically and than expands—with a trapezoidal cross section (part **28*a*)—before another, tapered cylindrical section 28*a*** is joined on, which has, at its free end, part of a bayonet fastener (not shown), to which a gas feed pipe (not shown) can be connected.

A said gas distribution chamber 26 is formed by the said body 28. Consequently, the said body 28, which can also be called a blast box, is designed as an independent component that is detachable from the gas purging plug. This makes it possible to connect the said blast box 28 to a gas purging plug of the class described at the plant, and to adapt the specific design of the blast box to the local conditions. This is another very substantial advantage of the described design of the gas purging plug.

As can be determined from FIG. 2, a thermocouple 32, with which the temperature of the gas being fed in can be measured, is connected in the area of the said section 28*a*.

In addition, a heating device 34, with which the treating gas can be preheated, is arranged in the said part 28*b*.

It would also be possible to arrange a pressure gauge within the said body 28 for measuring the gas pressure.

The said auxiliary devices may be installed permanently in the said body 28, because the said blast box 28 can be reused.

After the gas purging plug has become worn, the said blast box 28 is unscrewed from the said gas connection pipe 18 and—after inserting a new gas purging plug—is replaced on its gas connection pipe.

The said blast box 28 may be a part of a breakthrough-preventing means, whose design is described in DE 38,30,871 C1. It is, of course, also possible to connect the said breakthrough-preventing means to the said gas connection pipe 18 instead of the said body 28.

Another advantage is the fact that the said blast box 28 can also be equipped with a plurality of gas feed lines, so that it is also possible to feed in different gases and/or gas-solid mixtures.

The embodiment according to FIG. 3 differs from the embodiment according to FIG. 1 by two characteristics only.

On the one hand, the free, lower end of the said connection pipe 18 is tapered, as a result of which a separate gas distribution chamber 26 is formed. On the other hand, the said upper section 18*b* of the said connection pipe 18 is not sealed in the said ceramic matrix material 20, but is inserted into a corresponding annular groove and is fixed there with mortar. The said annular groove 35 can be removed after preparation of the said ceramic body 10, e.g., by milling.

While the exemplified embodiments according to FIGS. 1 through 3 show truncated cone-shaped gas purging plugs, the purging plug according to FIG. 4 has an essentially rectangular cross section. The cross sectional area is slightly larger at the lower end than at the upper end.

Another difference is that the purging plug according to FIG. 4 is a purging plug with oriented porosity. To achieve this, a gas-permeable insert 38 is placed into a nonpermeable refractory holder 40. The said insert 38 ends at a spaced location from the said bottom 14 of the said ceramic body 10. A gas distribution chamber 26, which extends in the downward direction in the said gas connection pipe 18, whose said upper section 18*a* again extends in the said matrix material 20, and whose said lower section 18*b* projects over the said bottom 14, joins the lower end of the said insert 38.

The upper end of the said gas distribution chamber 26 is covered by a perforated plate 18*c* here, and the said section 18*a* is designed, on the bottom side, with a taper relative to it, in the same way as the said section 18*b*.

In addition, a gas-permeable plug 42 made of refractory ceramic is inserted into the said gas distribution chamber 26. This design is suitable especially when the said gas distribution chamber 26 has no cover, and gas canals extend from the said plug 42 to the said upper end face 16 of the said purging plug instead of the said section 38 with non-oriented porosity.

Based on the design described, reinforcing elements on the said gas connection pipe 18 may be dispensed with, because the gas outlet-side part of the said section 18*a* (said gas distribution chamber 26) is already designed as an expanded part.

The components can be attached to the lower end of the said gas outlet pipe connection 18, as was explained on the basis of FIGS. 1 through 3.

Finally, FIG. 5 shows a truncated cone-shaped gas purging plug, in which the said gas connection pipe 18 has a pot-shaped design and is inserted into the said matrix material 20 with its open end pointing downward such that its lower end is flush with the said bottom 14. The said bottom, which is aranged at the top here, has a design similar to that of the said plate 18*c* in the exemplified embodiment according to FIG. 3. The said gas canals 12 are directly connected to the perforations provided in the said plate 18*c*.

The area within the said pot-shaped gas connection pipe 18 is hollow. Reinforcing anchors 22 for fixation in the said matrix material are arranged on the outside.

On the lower section, the said connection pipe 18 has internal threads 24' on the inside. The above-mentioned components can be connected via the said internal threads 24'. As is shown in FIG. 5, these components may comprise a blast box 28; it is also possible to directly connect a gas feed line.

It is common to all embodiments that the free, lower end of the said gas connection pipe 18 can also be used as an adapter for connecting an extraction device for the gas purging plug when, after wear, the purging plug is to be pulled out of a corresponding nozzle brick or the bottom of a metallurgical vessel.

Due to the secure and firm anchoring of the said connection pipe 18 in the said matrix material 20, strong forces can be transmitted into the purging plug, as a result of which it is possible to pull out pre-processed assembly units of purging plug and nozzle brick simultaneously. The components integrated in the refractory ceramic now preferably have a coefficient of thermal expansion that is as close to that of the matrix material of the purging plug as possible.

The geometry of the purging plug is not limited to the exemplified embodiments shown. It can be varied as needed.

We claim:

1. Gas purging plug of a refractory matrix material for metallurgical vessels, the plug comprising a bottom portion, an upper end face, a circumferential wall extending between said bottom portion and said upper end face, and a gas connection pipe, having an upper end portion and a lower end portion, wherein the gas connection pipe extends from below said bottom portion of the gas purging plug in a longitudinal direction of the plug and the gas connection pipe has an upper end portion inserted into the plug and is connected to a gas permeable section within said refractory matrix material, which section runs up to the upper end face of the gas purging plug, the upper end portion of the gas connection pipe being completely surrounded by the refractory matrix material inside and out, and being gas permeable throughout the upper end portion, the gas connection pipe including at the lower end portion means for making a gas-tight connection to a gas distribution chamber or a gas feed line at the lower-end portion thereof, outside the refractory matrix material of the plug.

2. Gas purging plug in accordance with claim 1 in which the lower end portion of the gas connection pipe has a free end, the gas connection pipe having a tapered cross section at said free end.

3. Gas purging plug in accordance with claim 1, the plug having an annular groove which extends from the bottom portion into the matrix material, at least the upper end portion of the gas connection pipe being anchored in said groove and being fixed in said groove with mortar.

4. Gas purging plug in accordance with claim 1 further including a gas distribution chamber formed in the plug groove and next to the upper end portion of the gas connection pipe, the chamber having a larger cross section than the gas connection pipe and being open in the longitudinal direction of the plug.

5. Gas purging plug in accordance with claim 4, the chamber being defined at an upper portion thereof by a plate which has openings in it.

6. Gas purging plug in accordance with claim 1, in which a gas-permeable ceramic plug is inserted into the upper end portion of the gas connection pipe and/or the gas distribution chamber.

7. Gas purging plug in accordance with claim 1, in which the gas-tight connecting means consists of a threaded section, a bayonet fastener, or a flanged connection.

8. Gas purging plug in accordance with claim 1, in which the upper end portion of the gas connection pipe extending in the matrix material has, on an outside portion thereof, reinforcing anchoring means fixed in the matrix material.

9. Gas purging plug in accordance with claim 1, in which the upper end portion of the gas connection pipe extending in the matrix material has perforations, and is filled with matrix material.

10. Gas purging plug in accordance with claim 1, in which the gas connection pipe, the ceramic plug and the anchoring means extending in the matrix material of the gas purging plug, consist of a material whose coefficient of thermal expansion is close to that of the matrix material.

11. Gas purging plug of a refractory matrix material, for metallurgical vessels including a lower bottom, and upper end face and a circumferential wall between said bottom and said end face, with a gas connection pipe which has an upper end and which projects from below said bottom of the gas purging plug and extends in the direction of said end face and the upper end of said gas connection pipe being connected to a gas permeable section within said refractory matrix material which runs up to the end face of the gas purging plug, wherein the upper end of said gas connection pipe is located completely within the gas permeable section of said refractory matrix material and including means for a gas-tight connection to a gas distribution chamber or a gas feed line at a lower end of the gas connection pipe outside the refractory matrix material of the gas purging plug.

* * * * *